United States Patent [19]

Ockler

[11] Patent Number: 4,917,193

[45] Date of Patent: Apr. 17, 1990

[54] FIRE SUPPRESSION ATTACHMENT FOR RUBBER-TIRED SKIDDER VEHICLES

[76] Inventor: Lloyd H. Ockler, 337 Conifer Dr., Huson, Mont. 59846

[21] Appl. No.: 208,878

[22] Filed: Jun. 20, 1988

[51] Int. Cl.[4] ..... A62C 27/06

[52] U.S. Cl. ..... 169/24; 169/30; 169/33; 169/13; 169/62

[58] Field of Search ..... 169/54, 62, 13, 24, 169/30, 33, 67; 414/460, 461; 239/100, 148, 172, 175, 176

[56] References Cited

U.S. PATENT DOCUMENTS

| | | | |
|---|---|---|---|
| 2,367,032 | 1/1945 | La Bour | 169/24 |
| 2,554,556 | 5/1951 | Bobard . | |
| 2,596,473 | 5/1952 | Essick | 239/172 |
| 2,618,509 | 11/1952 | Carlson . | |
| 2,680,624 | 6/1954 | Pool et al. . | |
| 2,694,455 | 11/1954 | Eickmeyer | 169/24 |
| 2,757,958 | 8/1956 | Bussey et al. . | |
| 3,265,428 | 8/1966 | Gilbert et al. | 414/460 |
| 3,583,718 | 6/1971 | Meyer . | |
| 3,605,908 | 9/1971 | McDonald et al. | 239/172 |
| 3,688,846 | 9/1972 | Lease | 169/16 X |
| 3,770,060 | 11/1973 | Forsyth et al. | 169/24 |
| 3,856,274 | 12/1974 | Stevenson . | |
| 4,232,874 | 11/1980 | Ystebo . | |
| 4,291,769 | 9/1981 | Muller | 169/24 X |
| 4,345,654 | 8/1982 | Carr | 169/13 X |
| 4,515,311 | 5/1985 | Takata . | |
| 4,593,855 | 6/1986 | Forsyth | 169/24 X |
| 4,729,434 | 3/1988 | Rohrbach | 169/24 X |

*Primary Examiner*—Joseph F. Peters, Jr.
*Assistant Examiner*—Anne Sartelle
*Attorney, Agent, or Firm*—Seed and Berry

[57] ABSTRACT

An attachment for a rubber-tired skidder vehicles which is releasably and supportably mountable to the skidder. The attachment comprises a tank which includes a water tank compartment for storing water and a drive tank compartment for storing a hydraulic motor and a pump operable from the motor. Coupling hoses are provided for coupling the hydraulic motor to a hydraulic power supply of the skidder. The attachment further includes a discharge hose, a suction hose and first and second valves such that the tank may be selectively operated to: (1) pump water from the water tank compartment through the discharge hose; (2) pump water from the suction hose to the water tank compartment; or (3) pump water from the suction hose to the discharge hose.

12 Claims, 1 Drawing Sheet

FIRE SUPPRESSION ATTACHMENT FOR RUBBER-TIRED SKIDDER VEHICLES

TECHNICAL FIELD

The present invention is related to rubber-tired skidder vehicles and, more particularly, to a fire suppression tank for mounting to the rear arc of the skidder for use in the suppression and extinction of fires in remote, rugged and uneasily accessed terrain.

BACKGROUND OF THE INVENTION

It is generally desirable to suppress and extinguish fires in an uncontrolled burn. However, suppression of fires in remote, rugged and uneasily accessed terrain, such as forest areas, has previously been accomplished primarily by utilization of manual labor. Typically, water tanks are carried by human fire fighters to the site of the fire. Obviously, the quantity of water which can be transported in this fashion is severly limited and the transportation time is long. Accordingly, this method of fire fighting is not only quite inefficient, but in many cases can expose fire fighters to hazardous conditions.

It is therefore desirable to provide improved apparatus and methods for fighting fire in an uncontrolled burn, which fires may occur in rugged, remote and uneasily accessed terrain.

DISCLOSURE OF THE INVENTION

The present invention comprises an attachment for a rubber-tired skidder vehicle of the type which includes a power supply for the skidder. The attachment apparatus comprises a tank which includes a water tank compartment adapted to store water and a drive tank compartment. Mounting means are provided for supportably and releasably mounting the tank to the skidder. Pump means for pumping water from the water tank compartment are responsive to the skidder power supply and are housed in the drive tank compartment of the tank. A discharge hose is coupled to the pump means to discharge water stored in the water tank compartment.

In alternative embodiments, a suction hose is mounted to the exterior of the tank and extends into the interior of the water tank compartment. First valve means are mounted to the tank for selectively coupling the pump means to draw water from the suction hose or from the water tank compartment. Also, second valve means are mounted to the tank for selectively coupling the pump means to discharge water to the discharge hose or the water tank compartment. In this embodiment, the pump means may be used to fill the tank, empty the tank or pump water directly from an external water source via the suction hose to the discharge hose.

BEST MODE FOR CARRYING OUT THE INVENTION

Figure 1:
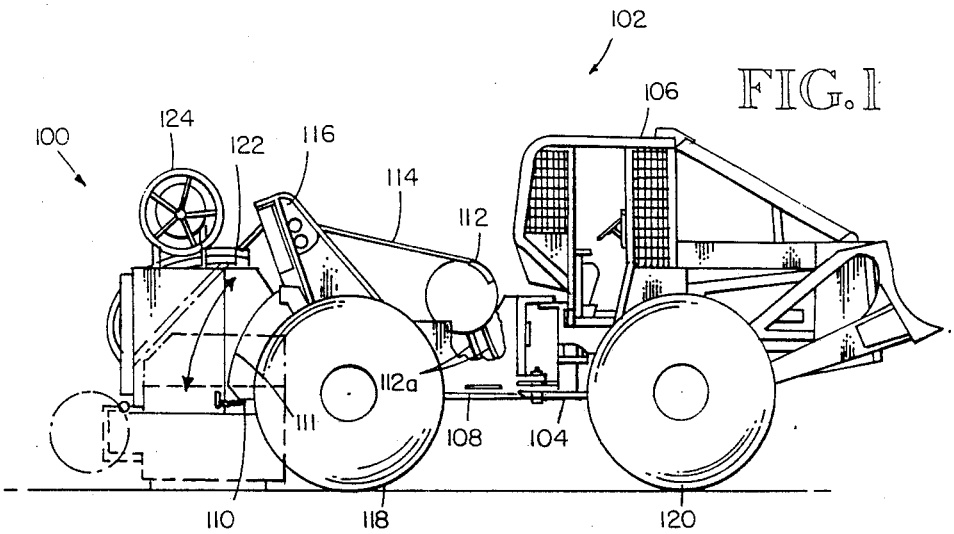
FIG. 1 is an illustration of the rubber-tired skidder vehicle for use with the present invention particularly illustrating the manner in which the fire suppression attachment is mounted to the skidder.

The present invention is a fire suppression attachment 100 which may be releasably mounted to a rubber-tired skidder 102 such as that shown in FIg. 1. The skidder

102 of FIG. 1 is a centrally articulated skidder including rear and front rubber tires 118 and 120, respectively, for use in rough terrain and typically used in logging applications. The skidder 102 includes a front skidder portion 104 having a cab 106 mounted thereon wherein an operator may be seated during use of the skidder. The skidder 102 also includes a rear skidder portion 108 having a pair of fenders 110 mounted thereto to protect the rear tires 118 from puncture or other damage during operation. The fenders 110 define a towing compartment 111 therebetween in which logs are normally housed during towing. The present invention advantageously uses the towing compartment 111 for mounting the fire suppression attachment 100, as will be described below.

A hydraulic winch 112 is mounted to the rear skidder portion 108 and is powered by a hydraulic power supply 109 which is an integral feature of the skidder 102 through a pressure hose **112*a*. The winch 112 is coupled to a winch cable 114 which extends over a cable support arc 116 for supporting the cable 114 against the force of gravity. Typically, the cable 114 includes a clamp or other gripping mechanism (not shown) for gripping logs which are to be hauled by the skidder 102 from the cutting area of the forest to a common loading area for loading the logs on trucks for subsequent transportation. The fenders 110 provide protection of the rear tires 118 of the skidder 102** from puncture or other damage which may be imposed by logs that are towed by the skidder.

The attachment 100 of the present invention includes a yoke 122 to which the gripping mechanism of the cable 114 may be attached for lifting the attachment 100. As shown in FIG. 1, the attachment 100 may be coupled to the cable 114 and lifted between the fenders 110 and nestled in the towing compartment 111 to be supportably mounted to the skidder 102.

Figure 2:
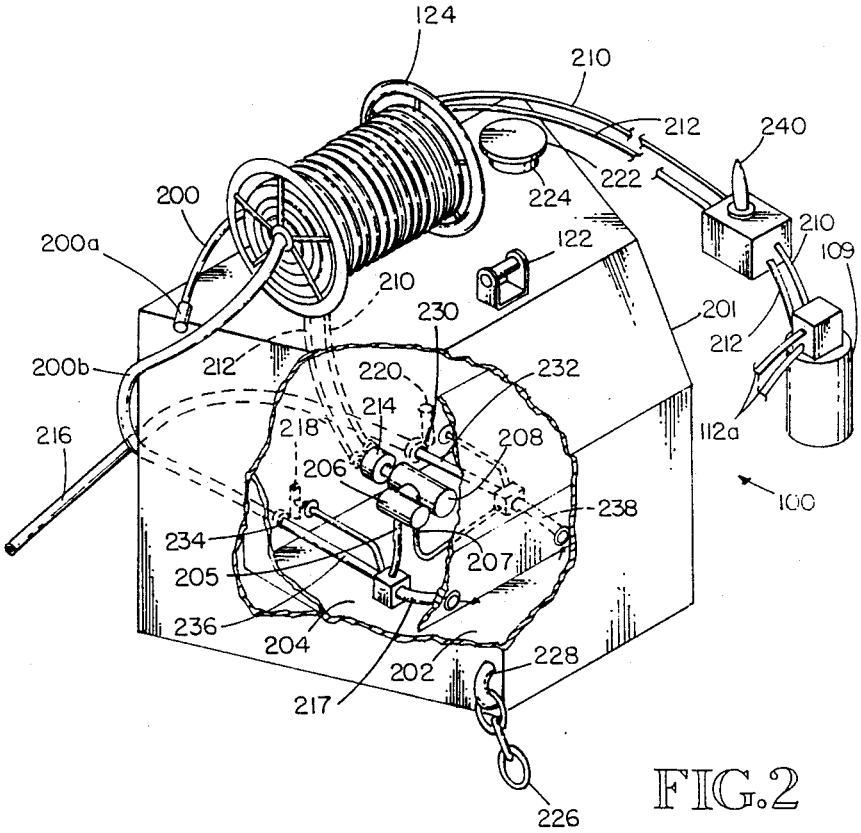
FIG. 2 is a partial, sectional illustration of the fire suppression apparatus shown in FIg. 1 which is the subject of the present invention.

The attachment 100 includes a reel 124 upon which is wound a discharge hose 200 having an adjustable nozzle 200a at its free end, as best shown in FIG. 2. The attachment 100 further includes a steel walled tank 201 having a water tank compartment 202 and a drive tank compartment 204. The tank 201 has a forwardly tapering shape to fit tightly between the fenders 110 and fully utilize the available space. The water tank compartment 202 is adapted to store about 250 gallons of water and includes baffles to reduce water from sloshing from side-to-side during transport of the tank 201, and thereby to prevent the vehicle from overturning.

The drive tank compartment 204 holds a water pump 206 which is coupled to a hydraulic motor 208. The hydraulic motor receives hydraulic power from the hydraulic power supply of the skidder 102 via hydraulic input and output lines 210 and 212, respectively, and a connector 214 mounted to the tank rearward sidewall. The hydraulic input and output lines 210 and 212 include means for quickly coupling the lines 210 and 212 to the hydraulic power supply 109 of the skidder 102. In the presently preferred embodiment, quick-couple couplers are connected to the input and output lines 210 and 212 for quickly coupling and decoupling the hydraulic motor 208 to the hydraulic power supply 109 of the skidder 102.

The hydraulic motor 208 is provided for powering the pump 206 as is known in the art. The water pump 206 operates at 50 gallons per minute at 2000 p.s.i., and has an outlet port 205 for discharging water and an inlet port 207 for receiving water to be pumped. Although the presently preferred embodiment is described by reference to a hydraulic motor 208 which is operable from a hydraulic power supply, it will be appreciated by those skilled in the art that any conventionally powered motor may be readily substituted for the hydraulic motor 208. However, hydraulic power is preferred as it is readily available on a plurality of skidders 102 which are presently in use.

The attachment 100 further includes a suction hose 216 which is mounted to the tank sidewall and has a strainer (not shown) as its free end. The suction hose 216 is attachable via a coupler 230 to a first internal hose 232 which extends into the end of the drive tank compartment 204. Similarly, the discharge hose 200 includes an interior portion **200*b* which is attachable via a coupler 234 to a second internal hose 236 which extends into the interior of the drive tank compartment 204. First and second valves 218 and 220 are mounted to the tank rearward sidewall so as to be operable from the exterior of the tank. Each valve 218 and 220 is a two-position valve for coupling the water pump 206 either to the water tank compartment 202 or to one of the hoses 216 or 200. The first valve 218 is provided for selectively coupling the outlet port 205 of the water pump 206 either to discharge water through the discharge hose 200 via the second internal hose 236 or to discharge water to the water tank compartment 202 via a third internal hose 217. The discharge hose 200 is attachable to the first internal hose 215 via the outlet port 205. The second valve 220 is provided for selectively coupling the water pump inlet port 207 either to draw water from the suction hose 216 via the first internal hose 232 or to draw water from the water tank compartment 202 via a fourth internal hose 238. The suction hose 216 is attachable to the third internal hose 226 via the inlet port 207. In this manner, the water pump 206 may be coupled to either: (1) pump water from the water tank compartment 202 through the discharge hose 200, or (2) pump water from the suction hose 216 to the water tank compartment 202, or (3) pump water from the suction hose 216 directly to the discharge hose 200**.

The attachment 100 also includes a cap 222 which is sealably mounted to a six inch aperture 224 on the top of the water tank compartment 202. The cap and aperture are sized and provided for dump-filling the water tank compartment by submerging the tank 201 in a reservoir of water to allow quick refill during emergency fire fighting operations.

In alternative embodiments of the invention, controls may be incorporated into the cab 106 of the skidder 102 to allow remote operation of the attachment 100. Particularly, a remote control switch 240 is provided in the cab 106 for control of the motor 208, and hence the water pump 206, to allow fire fighting operations to be initiated and/or terminated remotely by the operator in the cab.

It is noted that reel 124 may be either a manual reel which is mechanically retracted or may comprise a live reel such as those readily available that are automatically retracted. In the embodiment which includes a live reel, the reel may be operated by a hydraulic motor or may be operated by an electric motor as desirable.

Additionally, it may be desirable to provide means for securing the bottom of the tank to the skidder to prevent unnecessary movement of the tank during transport. As shown in FIG. 2, a chain 226 is mounted to the tank 201 via a support ring 228. The chain 226 may be securely attached to the fenders 110 of the skidder 102 after the tank is lifted into position by the winch cable 114.

It will be appreciated that, although specific embodiments of the invention have been described herein for purposes of illustration, various modifications may be made without departing from the spirit and scope of the invention. Accordingly, the invention is not limited except as by the appended claims.

I claim:

1. A log skidder, comprising:

an articulated, rubber-tired skidder having a front skidder portion upon which is supported a cab, a rear skidder portion, a pair of fenders mounted to said rear skidder portion and positioned to define a rearward towing compartment therebetween, a hydraulic winch mounted to said rear skidder portion and coupled to a winch cable, supply means for providing hydraulic power for activating said winch and other devices, and a cable support arc mounted to said rear skidder portion and supporting said cable;

a tank shaped to be positionable within and substantially fully utilize the space of said towing compartment of said rear skidder portion, said tank including an interior water tank compartment adapted to store water and an interior, dry drive tank compartment;

means for attaching said cable to said tank for lifting said tank into position within said towing compartment and supporting said tank therein during use of the log skidder;

a hydraulic motor mounted inside said drive tank compartment;

switch means for activating said hydraulic motor;

coupling means for coupling said supply means to said hydraulic motor;

a water pump coupled to said hydraulic motor and driven thereby, said water pump being mounted inside of said drive tank compartment and adapted to pump water in response to activation of said hydraulic motor, said pump including an inlet and an outlet;

a suction hose extending exterior of said tank and having a free end portion and a coupler end portion;

a discharge hose extending exterior of said tank and having a free exterior end portion and a coupler end portion;

first valve means mounted to said tank and coupled to said discharge hose coupler end portion, to said water tank compartment and to said water pump for selectively coupling said water pump outlet to discharge water either to said discharge hose or to said water tank compartment; and second valve means mounted to said tank and coupled to said suction hose coupler end portion, to said water tank compartment, and to said water pump for selectively coupling said water pump inlet to draw water either from said suction hose or from said water tank compartment as desired.

2. A log skidder as recited in claim 1, further comprising retention means for securing said tank to said fenders to restrict the motion of said tank relative to said rear skidder portion during use of the log skidder.

3. A log skidder as recited in claim 1, further comprising reel means for storing the exterior portion of said discharge hose, said reel means bing mounted to the exterior of and stop said tank.

4. Apparatus for mounting to a rubber-tired skidder of the type which includes a pair of rear fenders defining a rearward compartment therebetween, said apparatus comprising:

a removable tank including a water tank compartment adapted to store water, said tank being sized and shaped to be removably positioned in the rearward compartment between the fenders of the skidder;

mounting means for supportably and releasably mounting said tank to the skidder in the rear compartment;

pump means for pumping water from said water tank compartment; and a discharge hose coupled to said pump means and extending outside of said water tank compartment to discharge water stored in said water tank compartment.

5. Apparatus as recited in claim 4 wherein said tank further includes a dry drive tank compartment inside of which said pump means is housed, and wherein said pump means includes a motor mounted inside of said drive tank compartment, control means for selectively activating said motor, and a water pump driven by said motor to pump water through said discharge hose in response to activation of said motor.

6. Apparatus as recited in claim 4 wherein said apparatus further includes a suction hose mounted to the exterior of said tank and coupled to said pump means, and wherein said pump means is capable of selectively pumping water from an external water supply through said suction hose to fill said water tank compartment.

7. Apparatus as recited in claim 6 wherein said pump means further comprises:

first valve means mounted to said tank and coupled to said discharge hose and to said water tank compartment for selectively coupling said pump means to discharge water either to said discharge hose or to said water tank compartment; and second valve means mounted to said tank and coupled to said suction hose and to said water tank compartment for selectively coupling said pump means to draw water either from said suction hose or from said water tank compartment.

8. Apparatus as recited in claim 7 for use with a skidder having a hydraulic power supply, wherein said pump means comprises a hydraulic motor and includes means for coupling the skidder hydraulic power supply to said motor.

9. Apparatus as recited in claim 4, further comprising:

means for securing said tank to the skidder to restrict the motion of said tank relative to the skidder.

10. Apparatus as recited in claim 4, further comprising:

reel means for storing said discharge hose, said reel means being mounted to said tank.

11. Apparatus as recited in claim 4 wherein said tank further comprises:

an aperture positioned on the top of said tank sized for dump-filling said water tank compartment; and means for sealing said aperture to prevent inadvertent loss of water stored in said water tank compartment.

12. Apparatus as recited in claim 4 wherein said tank is shaped to be snugly positionable within said rearward compartment between the fenders of the skidder.

* * * * *